US009164420B2

(12) United States Patent
Handa

(10) Patent No.: US 9,164,420 B2
(45) Date of Patent: Oct. 20, 2015

(54) DEVELOPING DEVICE HAVING SEAL MEMBER AND RECESS PORTION IN THE DEVELOPING ROLLER

(71) Applicant: Hiroshi Handa, Inazawa (JP)

(72) Inventor: Hiroshi Handa, Inazawa (JP)

(73) Assignee: Bother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/092,114

(22) Filed: Nov. 27, 2013

(65) Prior Publication Data

US 2014/0153962 A1 Jun. 5, 2014

(30) Foreign Application Priority Data

Nov. 30, 2012 (JP) ..... 2012-263588

(51) Int. Cl.
*G03G 15/08* (2006.01)

(52) U.S. Cl.
CPC ..... *G03G 15/0817* (2013.01)

(58) Field of Classification Search
CPC ..... G03G 15/0817; G03G 15/0808; G03G 15/0008
USPC ..... 399/103
See application file for complete search history.

(56) References Cited

U.S. PATENT DOCUMENTS

| | | | | |
|---|---|---|---|---|
| 7,197,259 | B2 * | 3/2007 | Ohshika | 399/103 |
| 7,283,765 | B2 * | 10/2007 | Uratani et al. | 399/104 |
| 7,356,295 | B2 * | 4/2008 | Imamura | 399/286 |
| 2003/0180067 | A1 * | 9/2003 | Dougherty | 399/103 |
| 2004/0240909 | A1 * | 12/2004 | Morioka et al. | 399/279 |
| 2005/0095030 | A1 * | 5/2005 | Foster et al. | 399/103 |
| 2005/0226650 | A1 * | 10/2005 | Okamoto | 399/103 |
| 2007/0110484 | A1 * | 5/2007 | Yamada et al. | 399/286 |
| 2007/0147906 | A1 * | 6/2007 | Sakurai et al. | 399/286 |
| 2010/0080606 | A1 * | 4/2010 | Ohashi | 399/92 |
| 2010/0261111 | A1 * | 10/2010 | Aruga et al. | 430/105 |
| 2010/0261113 | A1 * | 10/2010 | Aruga et al. | 430/105 |
| 2011/0182627 | A1 * | 7/2011 | Shiraki et al. | 399/279 |
| 2012/0163879 | A1 * | 6/2012 | Joo et al. | 399/279 |
| 2014/0003845 | A1 * | 1/2014 | Tokudome et al. | 399/284 |
| 2014/0294434 | A1 * | 10/2014 | Imai et al. | 399/103 |

FOREIGN PATENT DOCUMENTS

| | | | |
|---|---|---|---|
| JP | 2009-145705 A | | 7/2009 |
| JP | 2009145705 A | * | 7/2009 |

OTHER PUBLICATIONS

Machine translation of JPA 2009145705.*

* cited by examiner

*Primary Examiner* — Billy Lactaoen
*Assistant Examiner* — Arlene Heredia Ocasio
(74) *Attorney, Agent, or Firm* — Banner & Witcoff, Ltd.

(57) ABSTRACT

A developing device including: a housing; a developing roller including a roller main body having a recess portion recessed inwards in an axis line direction, the recess portion including, a first surface extending in the axis line direction, and a second surface extending from an inner end portion of the first surface towards a direction intersecting with the axis line direction; and a seal member arranged between the housing and the roller main body, wherein, in the axis line direction, the second surface is positioned within a range in which the seal member is arranged, and wherein, in the axis line direction, a distance from an inner end portion of the seal member to the second surface is larger than a length of a part at which the seal member and the first surface overlap with each other.

9 Claims, 7 Drawing Sheets

DEVELOPING DEVICE HAVING SEAL MEMBER AND RECESS PORTION IN THE DEVELOPING ROLLER

CROSS-REFERENCE TO RELATED APPLICATIONS

This application claims priority from Japanese Patent Application No. 2012-263588 filed on Nov. 30, 2012, the entire contents of which are incorporated herein by reference.

TECHNICAL FIELD

Aspects of the invention relates to a developing device having a developing roller and a side seal.

BACKGROUND

A developing roller to be used for a developing device has been known which has a recess portion recessed inwards in a rotary shaft direction from an end surface of the developing roller (see JP-A-2009-145705). In this technology, the recess portion of the developing roller is hollow, so that heat can easily escape. Hence, it is possible to suppress a temperature of the developing roller from being increased.

SUMMARY

When the developing roller is made to be small in a width direction so as to miniaturize the developing device, a position of the developing roller corresponding to the recess portion may face a position where a side seal is arranged. In this case, since the position of the developing roller corresponding to the recess portion is easily bent, a contact pressure to the side seal may be weakened. Therefore, the developer may leak.

Accordingly, aspects of the invention provide a developing device capable of suppressing developer from leaking.

According to an aspect of the invention, there is provided a developing device including: a housing configured to accommodate developer therein; a developing roller including, a rotary shaft, and a roller main body having a recess portion that is recessed inwards in an axis line direction of the roller main body from an end surface of the roller main body, the recess portion including, a first surface extending in the axis line direction, and a second surface extending from an inner end portion of the first surface in the axis line direction towards a direction intersecting with the axis line direction; and a seal member arranged between the housing and the roller main body at an end portion of the roller main body in the axis line direction, wherein, in the axis line direction, the second surface is positioned within a range in which the seal member is arranged, and wherein, in the axis line direction, a distance from an inner end portion of the seal member in the axis line direction to the second surface is larger than a length of a part at which the seal member and the first surface overlap with each other in the axis line direction.

According to another aspect of the present invention, there is provided a developing device including: a housing configured to accommodate developer therein; a developing roller including, a rotary shaft, and a roller main body extending in an axis line direction and having a recess portion that is recessed inwards towards a first side in the axial direction from an end surface of the roller main body, the recess portion including a side surface and a bottom surface; and a seal member arranged between the housing and the roller main body in a direction perpendicular to the axis line direction, the seal member including a first side surface at the first side in the axis line direction and a second side surface at a second side in the axial direction which is opposite to the first side, wherein, in the axis line direction, the bottom surface of the recess portion is positioned between the first and second side surfaces of the seal member, and wherein, in the axis line direction, a distance between the first side surface of the seal member and the bottom surface of the recess portion is larger than a length of a portion of the seal member that overlaps with the side surface of the recess portion in the axis line direction.

According to the aspect, in the axis line direction, the distance from the inner end portion of the seal member in the axis line direction to the second surface is larger than a length of a part at which the seal member and the first surface overlap with each other in the axis line direction. Further, according to another aspect, in the axis line direction, a distance between the first side surface of the seal member and the bottom surface of the recess portion is larger than a length of a portion of the seal member that overlaps with the side surface of the recess portion in the axis line direction. Therefore, it is possible to enlarge a range in which the roller main body is securely sealed by the side seal member, compared to a range of the roller main body which easily bends. For this reason, it is possible to suppress leakage of the toner.

DETAILED DESCRIPTION

Hereinafter, an illustrative embodiment of the invention will be specifically described with reference to the drawings. Meanwhile, hereinafter, an overall configuration of a laser printer according to an illustrative embodiment of the invention will be first described and features of the invention will be then specifically described.

Meanwhile, in the following descriptions, directions are described, based on a user who is using the laser printer. That is, in FIG. 1, the left side is referred to as the 'front side', the right side is referred to as the 'rear side', the inner side is referred to as the 'left side' and the front side is referred to as the 'right side.' Also, the upper and lower directions are referred to as the 'upper-lower direction.'

<Schematic Configuration of Laser Printer>

Figure 1:
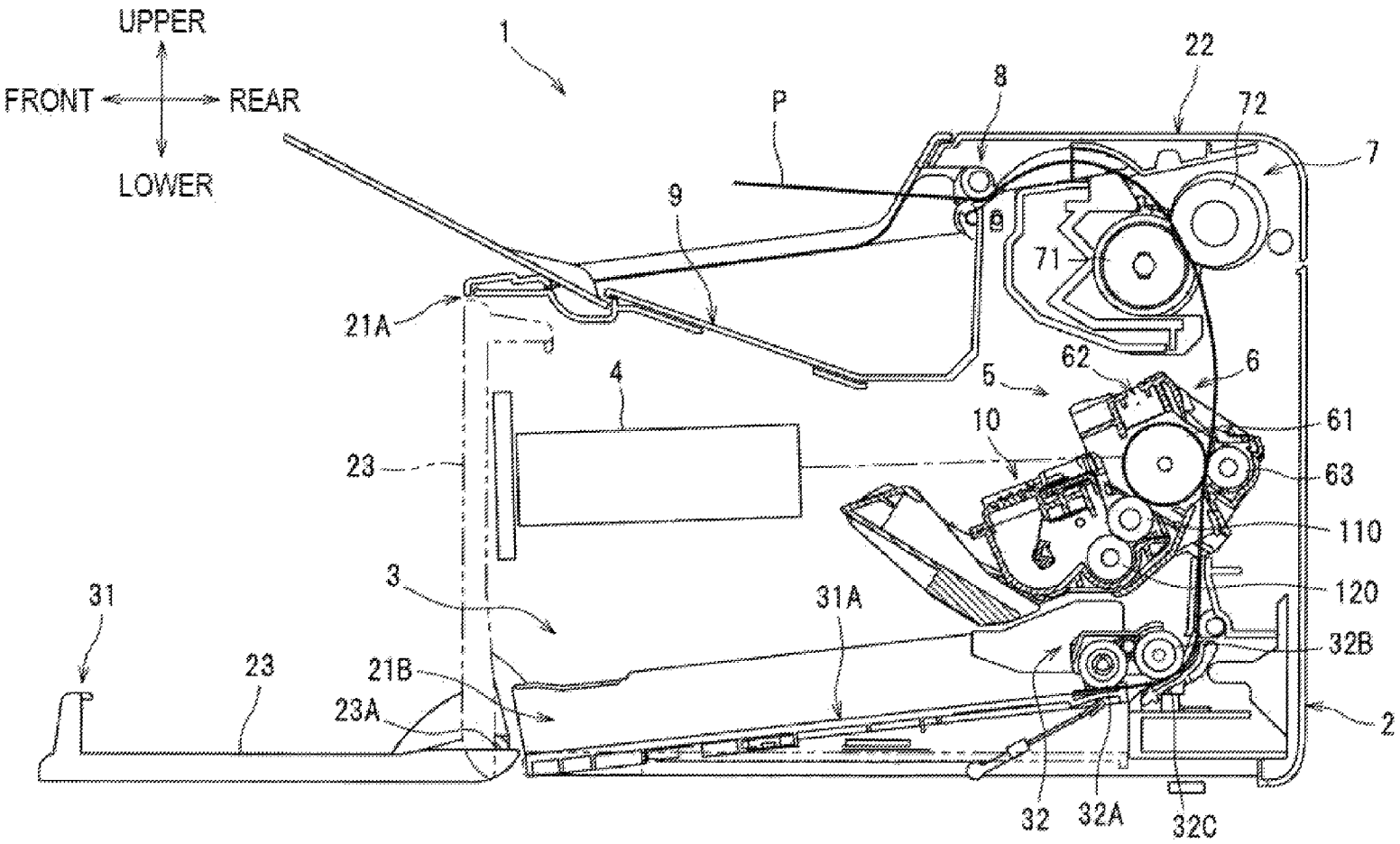
FIG. 1 is a sectional view of a laser printer having a developing cartridge according to an illustrative embodiment of the invention.

As shown in FIG. 1, a laser printer 1 mainly has an apparatus main body 2, a feeder unit 3 for feeding a sheet P, a scanner unit 4, a process cartridge 5 that transfers a toner image onto the sheet P and a fixing device 7 that heat-fixes the toner image on the sheet P.

The apparatus main body 2 has a top cover 22 and a front cover 23. Also, the apparatus main body 2 is formed at its upper part with an opening 21A for attaching and detaching the process cartridge 5 and at its front side part with an insertion opening 21B for inserting the sheet P.

The front cover 23 has a rotary shaft 23A that is provided at a front-lower part of the apparatus main body 2, and is thus configured to rotate forwards about the rotary shaft 23A. Incidentally, in FIG. 1, the front cover 23 shown with a dashed-two dotted line shows a state where the front side of the apparatus main body 2 is closed and the front cover 23 shown with a solid line shows a state where the front side of the apparatus main body 2 is opened.

The feeder unit 3 is located at a lower part of the apparatus main body 2 and has a sheet feeding tray 31 for placing the sheet P thereon and a sheet feeding mechanism 32 that feeds the sheet P on the sheet feeding tray 31.

The sheet feeding tray 31 is configured by a placing member 31A arranged at the lower part of the apparatus main body 2 and the front cover 23.

The sheet feeding mechanism 32 mainly has a feeder roller 32A, a separation roller 32B and a separation pad 32C. The feeder roller 32A is arranged above a rear end of the placing member 31A at an upstream side of the separation roller 32B in a conveying direction of the sheet P. The separation roller 32B is arranged to face the separation pad 32C.

The feeder unit 3 is configured so that the front cover 23 is brought down forwards to form the sheet feeding tray 31 and the sheet P can be then put on the sheet feeding tray 31. The feeder roller 32A is rotated while contacting the sheet P placed on the sheet feeding tray 31, so that the sheet P placed on the sheet feeding tray 31 is delivered to the separation roller 32B. The delivered sheet P is separated one by one between the separation roller 32B and the separation pad 32C and is then conveyed towards the process cartridge 5.

The scanner unit 4 is provided at the front side in the apparatus main body 2 and has a laser light emitting unit, a polygon mirror, a lens, a reflector and the like, which are not shown. The scanner unit 4 illuminates a laser beam on a surface of a photosensitive drum 61 (which will be described later) by a high-speed scanning.

The process cartridge 5 is positioned in the vicinity of a rear-central part of the apparatus main body 2 and is provided above the sheet feeding mechanism 32. The process cartridge 5 is configured so as to be detachable from the apparatus main body 2 towards the upper-front through the opening 21A, and has a drum unit 6 and a developing cartridge 10 that is an example of the developing device.

Figure 2:
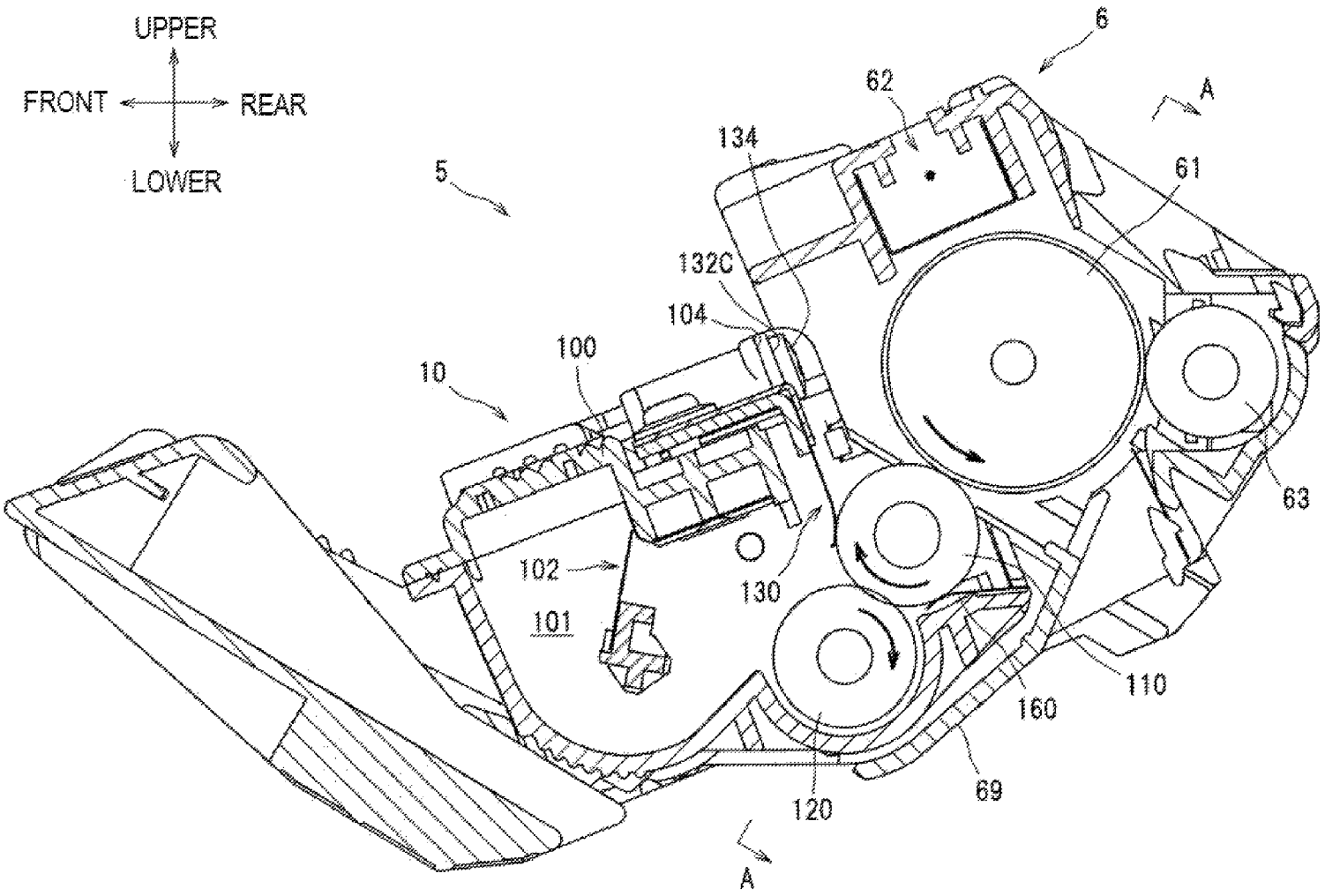
FIG. 2 is an enlarged view showing the developing cartridge according to the illustrative embodiment of the invention.

As shown in FIG. 2, the drum unit 6 has a drum frame 69 and a photosensitive drum 61, a charger 62 and a transfer roller 63 provided to the drum frame 69.

The developing cartridge 10 has a housing 100, a developing roller 110, a supply roller 120 and a layer thickness regulation blade 130 and is configured so as to be detachable from the drum unit 6. The housing 100 and the layer thickness regulation blade 130 will be specifically described later.

The developing roller 110 is a member configured to carry toner on a circumferential surface thereof and is rotatably mounted to the housing 100.

The supply roller 120 is a member configured to supply the toner attached on a circumferential surface thereof to the circumferential surface of the developing roller 110, and is arranged at a front lower side of the developing roller 110.

In the developing cartridge 10, the toner accommodated in a toner accommodation chamber 101 formed in the housing 100 is stirred by an agitator 102 and is then supplied to the developing roller 110 by the supply roller 120. At this time, the toner is positively friction-charged between the supply roller 120 and the developing roller 110. As the developing roller 110 is rotated, the toner supplied onto the developing roller 110 is introduced between the layer thickness regulation blade 130 and the developing roller 110 and is then carried on the developing roller 110 as a thin film having a predetermined thickness with being further friction-charged therebetween.

In the drum unit 6, a surface of the photosensitive drum 61 being rotated is uniformly charged by the charger 62 and is then exposed by the high-speed scanning of the laser beam emitted from the scanner unit 4. Thereby, a potential of the exposed part is lowered and an electrostatic latent image based on image data is thus formed on the surface of the photosensitive drum 61.

Then, the toner is supplied from the developing cartridge 10 to the electrostatic latent image, so that a toner image is formed on the surface of the photosensitive drum 61. After that, the sheet P is conveyed between the photosensitive drum 61 and the transfer roller 63, so that the toner image carried on the surface of the photosensitive drum 61 is transferred onto the sheet P.

Returning back to FIG. 1, the fixing device 7 is positioned at the upper-rear side of the apparatus main body 2 and is arranged above the process cartridge 5. The fixing device 7 mainly has a heating roller 71 and a pressing roller 72.

The heating roller 71 is a member that heats the sheet P, and is provided therein with a heat source (not shown) such as halogen lamp and the like.

The pressing roller 72 is a member that conveys the sheet P between the heating roller 71 and the pressing roller 72, and is provided obliquely upwards at the rear of the heating roller 71.

The fixing device 7 configured as described above heat-fixes the toner transferred on the sheet P while the sheet P passes between the heating roller 71 and the pressing roller 72. In the meantime, the sheet P heat-fixed by the fixing device 7 is conveyed towards a discharge roller 8 provided at a downstream side of the fixing device 7 and is discharged onto a discharge tray 9 from the discharge roller 8.

<Detailed Configuration of Developing Cartridge>

Subsequently, the configuration of the developing cartridge 10 will be described.

Figure 3:
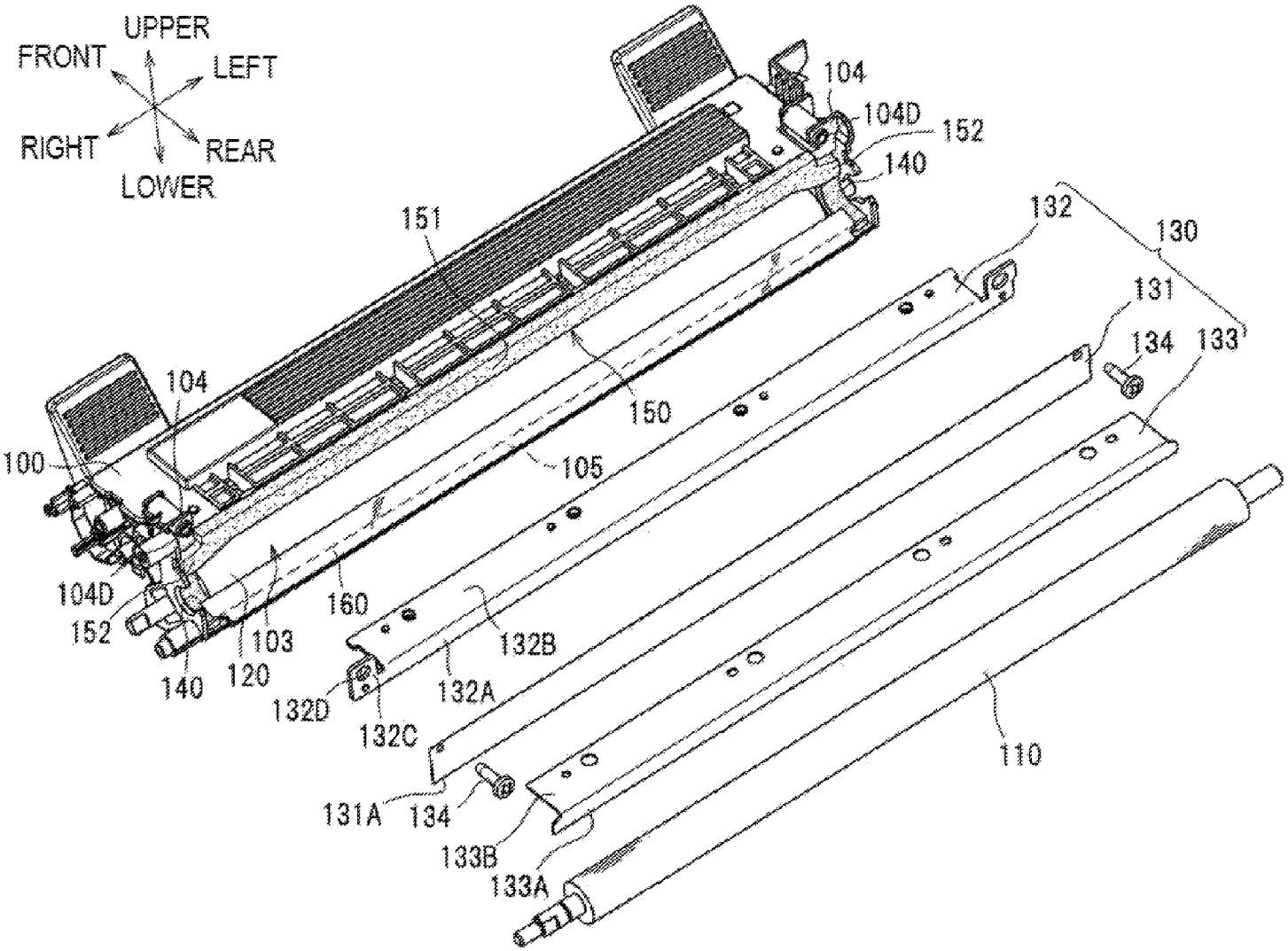
FIG. 3 is an exploded perspective view of the developing cartridge.

As shown in FIG. 3, the housing 100 is formed at its rear sidewall with an opening 103, and the developing roller 110 and the layer thickness regulation blade 130 are mounted thereto to close up the opening 103. The opening 103 is provided on the left, right, top and bottom thereof with side seal members 140, which are an example of the seal member, an upper seal member 150 and a film 160 so as to prevent the toner in the housing 100 from leaking. Also, the opening 103 is formed at both end portions of an upper edge thereof with support surfaces 104 for fixing the layer thickness regulation blade 130. The side seal member 140 will be specifically described later.

The support surfaces 104 are provided at both left and right end portions of the upper edge of the opening 103 and face the developing roller 110 (i.e., the rear side). The support surface 104 protrudes more rearwards than an attachment surface 106 of the upper seal member 150 in a front-rear direction of the housing 100 (refer to FIG. 7). The support surface 104 is formed with a hole 104D for inserting a screw 134 (which will be described later). The hole 104D is positioned slightly nearer a center in a left-right direction and is also arranged nearer the upper side on the support surface 104.

Figure 6:
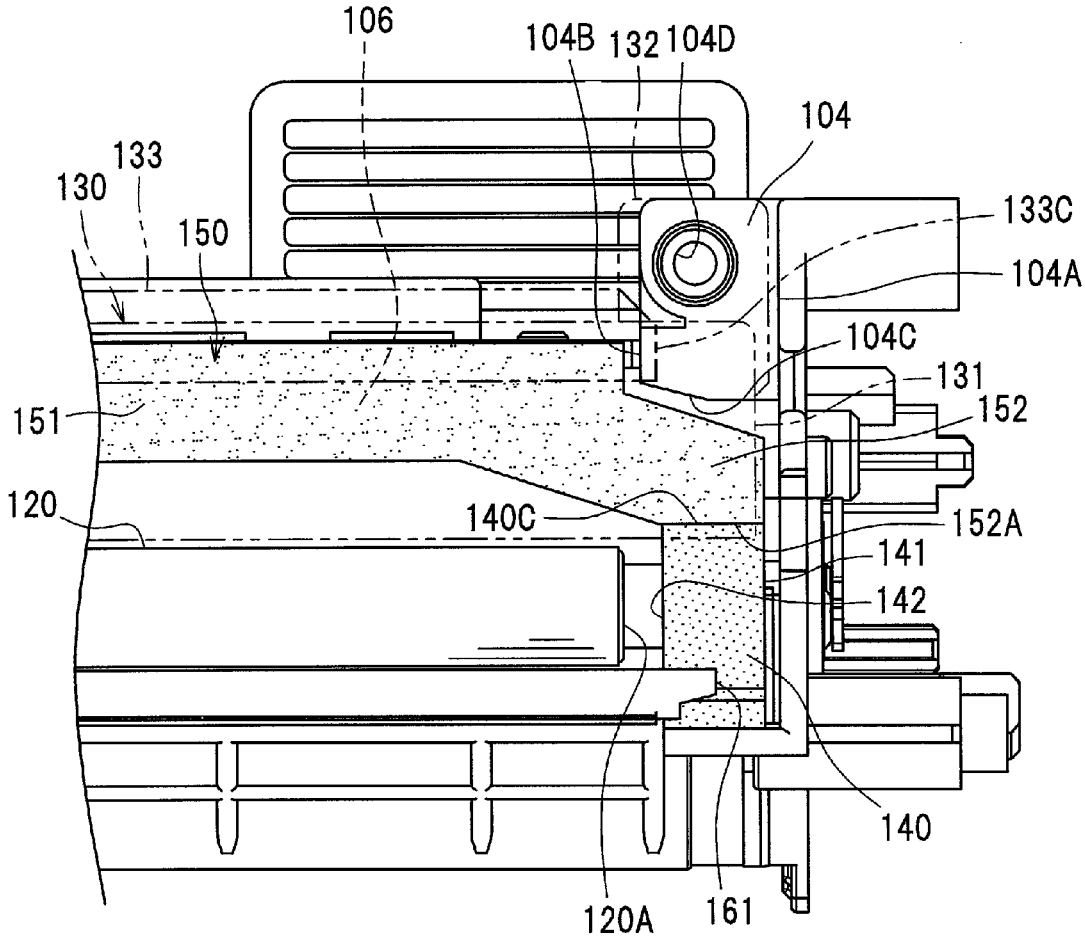
FIG. 6 is a partially enlarged rear view showing a vicinity of a left end portion of a housing shown in FIG. 3, which is seen from the rear side.

As shown in FIG. 6, the support surface 104 is formed so that an outer end portion 104A thereof in the left-right direction of the layer thickness regulation blade 130 is positioned at an outer side of an inner end portion 142 of the side seal member 140 in the left-right direction of the developing roller 110. An inner end portion 104B of the support surface 104 in the left-right direction is positioned at an inner side of the inner end portion 142 of the side seal member 140, at an outer side of an image forming range in the left-right direction of the developing roller 110.

Returning back to FIG. 3, the layer thickness regulation blade 130 has a blade main body 131, a blade holder 132 and a reinforcement plate 133.

The blade main body 131 is configured by a metal plate such as stainless steel and has a leading end portion 131A that is bent in an opposite direction than the developing roller 110 (refer to FIG. 2). The leading end portion 131A contacts with to the developing roller 110, so that it regulates a layer thickness of the toner on the developing roller 110.

The blade holder 132 has a blade support part 132A for supporting the blade main body 131, a reinforcement part 132B for attaching the reinforcement plate 133 and attachment parts 132C for attachment to the support surfaces 104. The attachment part 132C is formed with a hole 132D. The blade holder 132 is formed so that the reinforcement part 132B is bent forwards at a substantially right angle from an upper end of the blade support part 132A and the attachment parts 132C protrude upwards from both left and right end portions of the blade support part 132A.

The reinforcement plate 133 has a holding part 133A for holding the blade main body 131 between the blade holder 132 and the reinforcement plate 133 and a fixing part 133B for fixing the reinforcement plate 133 to the blade holder 132. The reinforcement plate 133 is formed so that the holding part 133A is bent downwards at a substantially right angle from a rear end of the fixing part 133B.

The layer thickness regulation blade 130 is configured into an integral component by holding the blade main body 131 between the blade support part 132A of the blade holder 132 and the holding part 133A of the reinforcement plate 133 and fastening the reinforcement part 132B of the blade holder 132 and the fixing part 133B of the reinforcement plate 133 by screws (not shown). The layer thickness regulation blade 130 configured in this way is fixed to the housing 100 by enabling the screws 134 to pass through the holes 132D of the attachment parts 132C of the blade holder 132 and then to be screwed into the holes 104D formed in the support surfaces 104.

Figure 7:
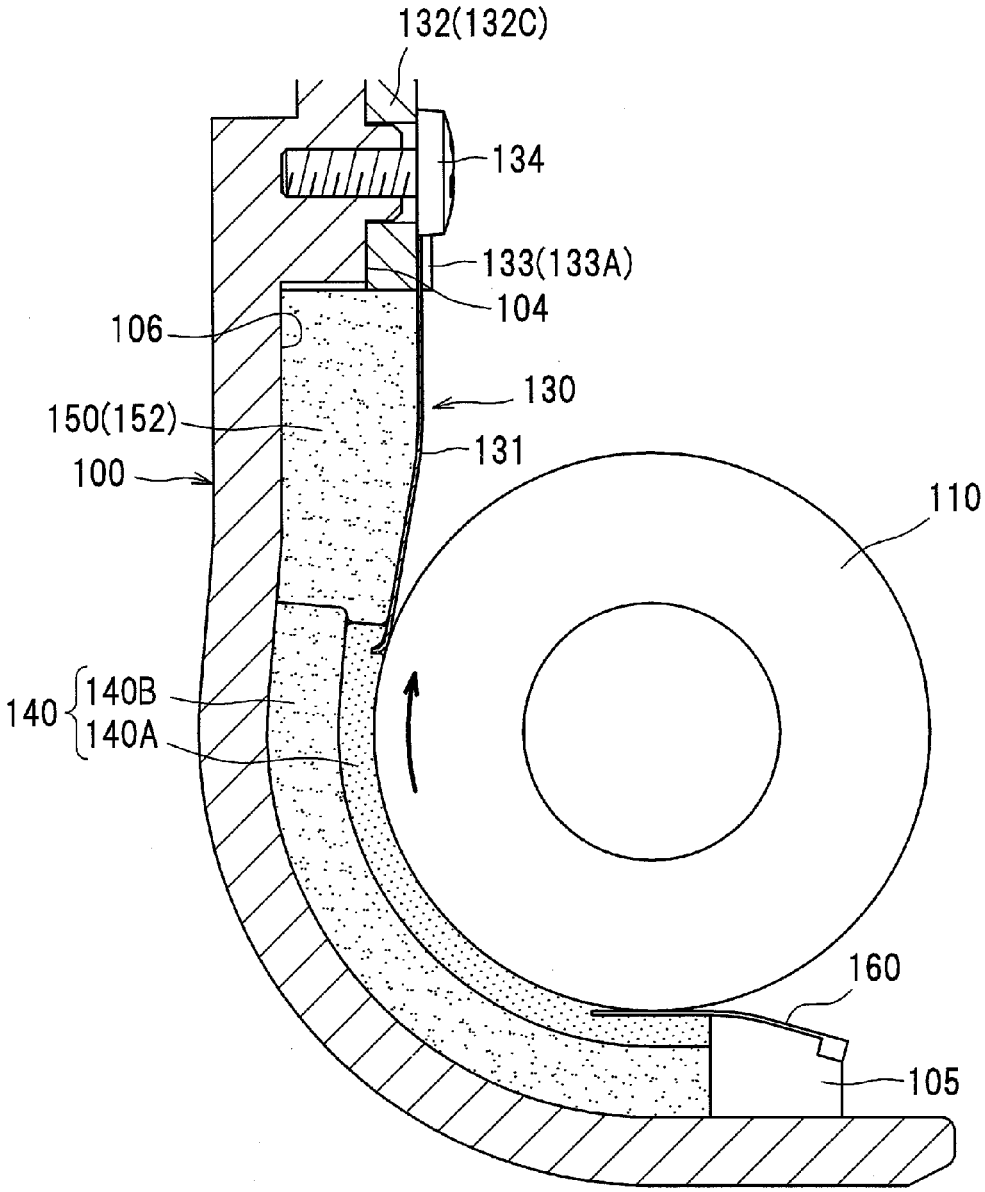
FIG. 7 is a sectional view showing surroundings of a right side seal member and an upper seal member of the developing cartridge.

The side seal member 140 is arranged between the housing 100 and a roller main body 112 at an end portion in the left-right direction (an axis line direction of the roller main body 112). The side seal member 140 has a shape corresponding to the outer periphery shape of the roller main body 112, and an outer end portion 140A thereof (refer to FIG. 4) in the left-right direction is positioned at an outer side of the roller main body 112. As shown in FIG. 7, the side seal member 140 has a sliding contact member 140A and a base material 140B.

The sliding contact member 140A is a member contacting with the circumferential surface of the developing roller 110 and has a nappy surface that is formed by weaving fiber such as PTFE (polytetrafluoroethylene), PET (polyethylene terephthalate), acryl and nylon.

The base material 140B is arranged between the housing 100 and the sliding contact member 140A and is made of a sponge material having a cushioning characteristic such as urethane foam and silicon sponge.

Returning back to FIG. 3, the upper seal member 150 is arranged between the housing 100 and the layer thickness regulation blade 130 and is made of a sponge material such as urethane foam, silicon sponge and the like. The upper seal member 150 has a central part 151 extending in the left-right direction and connection parts 152 extending obliquely downwards from both left and right end portions of the central part 151 and connecting to the side seal members 140. The central part 151 and the connection parts 152 are integrally formed.

As shown in FIG. 6, the connection part 152 is arranged between the side seal member 140 and the support surface 104 and has a lower edge portion 152A having a horizontal and straight line shape. The lower edge portion 152A contacts with an end surface 140C of the side seal member 140, so that the toner is prevented from leaking between the upper seal member 150 and the side seal member 140.

Returning back to FIG. 3, the film 160 is fixed to the housing 100 along a lower edge of the opening 103 between the developing roller 110 and the housing 100 and is made of PET, acryl, fluorine resin and the like. The film 160 extends in the left-right direction and has a leading end portion that is configured to slidably contact with the circumferential surface of the developing roller 110. Also, both end portions 161 of the film 160 in the left-right direction are arranged to overlap with the side seal members 140. The film 160 is attached to a film attachment part 105 extending in the left-right direction (refer to FIG. 7). The leading end portion of the film 160 is arranged so as to extend from the film attachment part 105 towards an inside of the housing 100.

<Detailed Configuration of Developing Roller>

Figure 4:
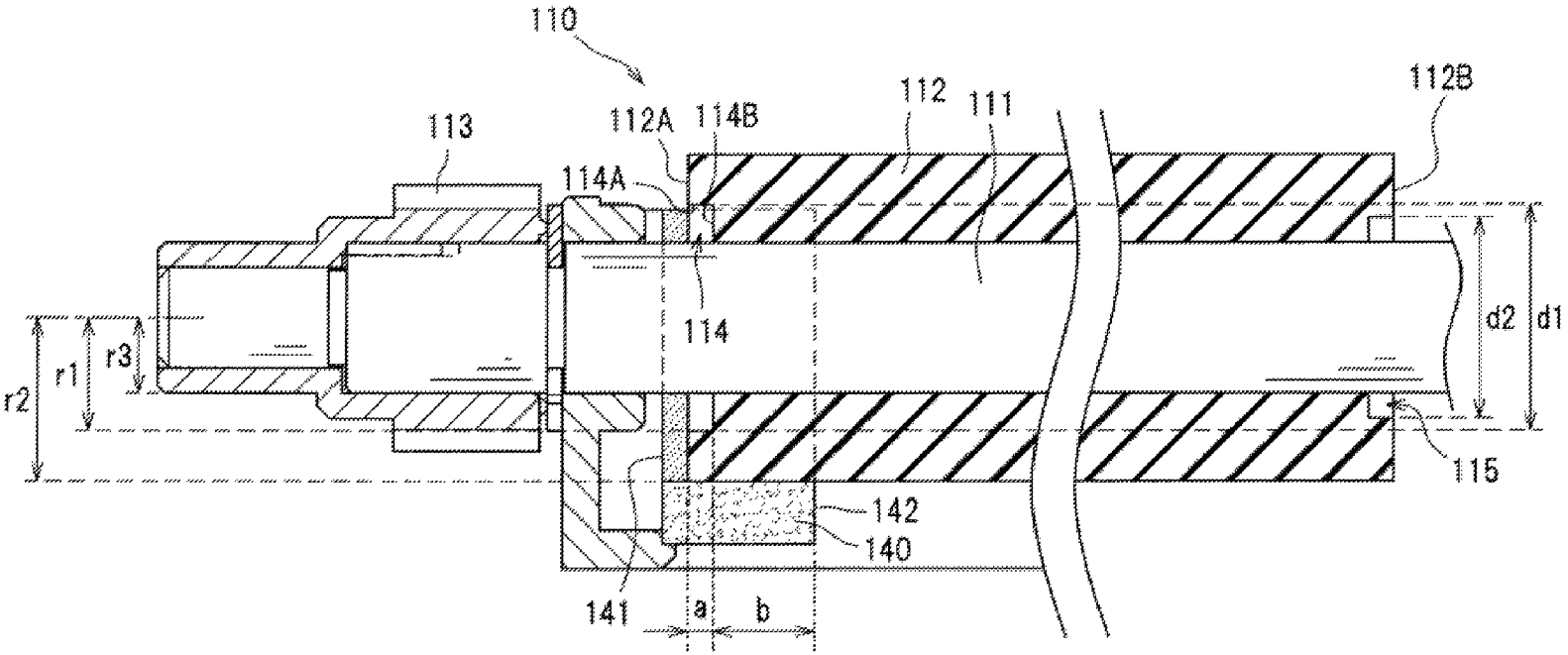
FIG. 4 is a sectional view taken along a line A-A of FIG. 2, which shows a developing roller.

As shown in FIG. 4, the developing roller 110 has a rotary shaft 111 and the roller main body 112. Further, a developing roller gear 113, which is an example of the driving force input member to which a driving force is applied from the exterior and thus rotates the rotary shaft 111, is provided at a right end (a left end in FIG. 4) of the rotary shaft 111.

The roller main body 112 is provided with recess portions 114, 115 that are recessed inwards in the left-right direction from end surfaces 112A, 112B of both left and right end portions thereof.

The right (one end side) recess portion 114 has a diameter d1 that is larger than a diameter d2 of the left (the other end side) recess portion 115. Hereinafter, only the right recess portion 114 will be described in detail. In other words, since the left recess portion 115 has the same configuration the right recess portion 115, the detailed description thereof is omitted.

The recess portion 114 has a first surface 114A forming a side surface and a second surface 114B forming a bottom surface.

The first surface 114A extends in the left-right direction and is arranged to overlap with the side seal member 140 in the left-right direction. The first surface 114A is provided at an interval from the rotary shaft 111 in a direction intersecting with the left-right direction.

The second surface 114B extends from an inner end portion of the first surface 114A in the left-right direction towards the rotary shaft 111 in the direction intersecting with the left-right direction and is positioned within a range in which the side seal member 140 is arranged.

More specifically, the first surface 114A and the second surface 114B are arranged at a position at which, in the left-right direction, a distance b from the inner end portion 142 of the side seal member 140 in the left-right direction to the second surface 114B becomes larger than a distance a of a part at which the side seal member 140 and the first surface 114A overlap with each other in the left-right direction.

Further, the recess portion 114 is formed so that a difference between a radius r1 of the recess portion 114 and a radius r3 of the rotary shaft 111 is a half of or smaller than a difference between a radius r2 of the developing roller 110 and the radius r3 of the rotary shaft 111.

In the developing cartridge 10 configured as described above, it is possible to enlarge the range in which the roller main body 112 is securely sealed by the side seal member 140 (the range of the distance b), compared to the range in which the roller main body 112 is bent at the recess portion 114 (the range of the distance a). For this reason, it is possible to sufficiently secure a contact pressure between the roller main body 112 and the side seal member 140, thereby suppressing leakage of the toner.

Further, the roller main body 112 is configured so that a diameter d1 of the right recess portion 114 is larger than a diameter d2 of the left recess portion 115. Thereby, it is possible to easily radiate heat of the developing roller gear 113 from which the heat is easily generated.

Further, the recess portion 114 is configured so that the difference between the radius r1 of the recess portion 114 and the radius r3 of the rotary shaft 111 is a half of or smaller than the difference between the radius r2 of the developing roller 110 and the radius r3 of the rotary shaft 111. Thereby, it is possible to reduce excessive bending of the developing roller 110.

Although the illustrative embodiment of the invention has been described, the invention is not limited thereto. The specific configuration can be appropriately changed without departing from the scope of the invention.

Figure 5:
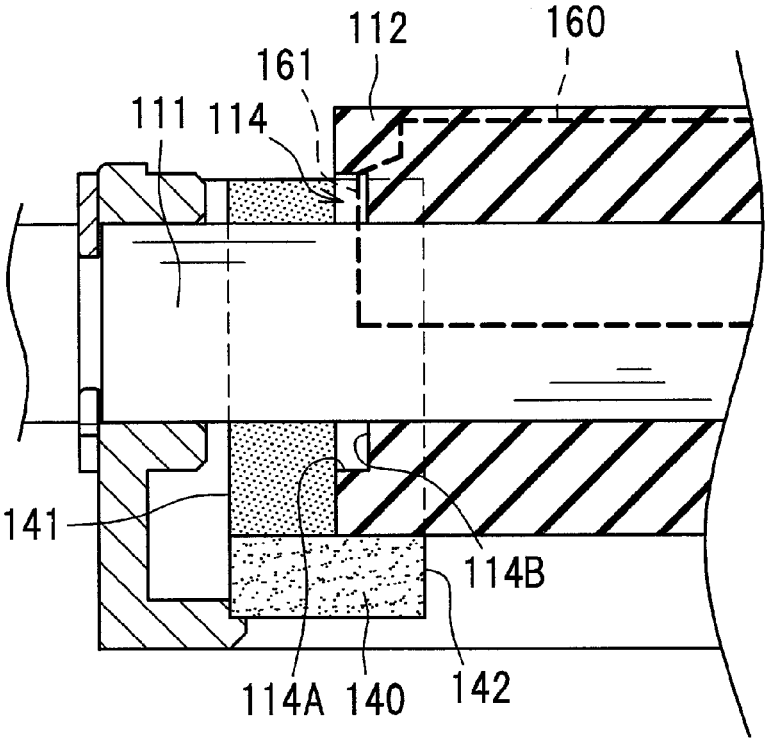
FIG. 5 shows a right end portion of a roller main body according to a modified embodiment, which corresponds to FIG. 4.

In the above-described illustrative embodiment, both left and right end portions 161 of the film 160 are positioned to overlap with the side seal members 140. Here, as shown in FIG. 5, in the left-right direction, both left and right end portions 161 of the film 160 may be positioned within the range in which the recess portions 114 are arranged.

By the above configuration, it is possible to suppress the contact pressure between the end portion 161 of the film 160 and the roller main body 112 to be low at the part of the roller main body 112 to which the recess portion 114 is formed and stiffness is lowered. Therefore, it is possible to suppress the roller main body 112 from being scraped by the end portion 161 of the film 160.

In the above-described illustrative embodiment, the outer end portion 141 of the side seal member 140 in the left-right direction is positioned at the outer side of the roller main body 112. However, the invention is not limited thereto. That is, the position of the outer end portion 141 of the side seal member 140 in the left-right direction can be arbitrarily set insofar as the distance b is larger than the distance a.

In the above-described illustrative embodiment, the developing cartridge 10 has been exemplified as the developing device of the invention. However, the invention is not limited thereto. For example, the invention can be also applied to a so-called process cartridge having a photosensitive drum and a developing roller.

In the above-described illustrative embodiment, the invention has been applied to the laser printer 1. However, the invention is not limited thereto. That is, the invention can be also applied to the other image forming apparatuses, for example, a copier, a complex machine and the like.

What is claimed is:

1. A developing device comprising:

a housing configured to accommodate developer therein;

a developing roller including, a rotary shaft, and a roller main body having a recess portion that is recessed inwards in an axis line direction of the roller main body from an end surface of the roller main body, the recess portion including, a first surface extending in the axis line direction, and a second surface extending from an inner end portion of the first surface in the axis line direction towards a direction intersecting with the axis line direction; and a seal member arranged between the housing and the roller main body at an end portion of the roller main body in the axis line direction, wherein, in the axis line direction, the second surface is positioned within a range in which the seal member is arranged, and wherein, in the axis line direction, a distance from an inner end portion of the seal member in the axis line direction to the second surface is larger than a length of a part at which the seal member and the first surface overlap with each other in the axis line direction.

2. The developing device according to claim 1, wherein an outer end portion of the seal member in the axis line direction is positioned at an outer side of the roller main body.

3. The developing device according to claim 1, further comprising a driving force input member that is provided to one end of the rotary shaft and is configured to receive a driving force to thus rotate the rotary shaft, wherein the recess portion includes a first recess portion and a second recess portion, the first recess portion being provided at a first end portion of the roller main body and the second recess portion being provided at a second end portion of the roller main body opposite to the first end portion, and wherein a first diameter of the first recess portion is larger than a second diameter of the second recess portion.

4. The developing device according to claim 1, further comprising a film that is fixed to the housing, extends in the axis line direction, has a leading end portion configured to slidably contact with a circumferential surface of the developing roller, and is made of at least one of PET, acryl and fluorine resin, wherein the housing has an opening in which the developing roller is arranged, wherein the film is arranged along an edge of the opening between the developing roller and the housing, and wherein, in the axis line direction, an end portion of the film in the axis line direction is positioned within a range in which the recess portion is arranged.

5. The developing device according to claim 1, wherein a difference between a radius of the recess portion and a radius of the rotary shaft is a half of or smaller than a difference between a radius of the developing roller and the radius of the rotary shaft.

6. A developing device comprising:

a housing configured to accommodate developer therein;

a developing roller including, a rotary shaft, and a roller main body extending in an axis line direction and having a recess portion that is recessed inwards towards a first side in an axial direction from an end surface of the roller main body, the recess portion including a side surface and a bottom surface; and a seal member arranged between the housing and the roller main body in a direction perpendicular to the axis line direction, the seal member including a first side surface at the first side in the axis line direction and a second side surface at a second side in the axial direction which is opposite to the first side, wherein, in the axis line direction, the bottom surface of the recess portion is positioned between the first and second side surfaces of the seal member, and wherein, in the axis line direction, a distance between the first side surface of the seal member and the bottom surface of the recess portion is larger than a length of a portion of the seal member that overlaps with the side surface of the recess portion in the axis line direction.

7. The developing device according to claim 2, wherein the outer end portion of the seal member in the axis line direction is positioned at an outer side of an outer edge of the roller main body in the axis line direction, and wherein the outer edge of the roller main body is positioned at an outer side than a center of the seal member in the axis line direction.

8. The developing device according to claim 3, wherein the first diameter of the first recess portion has a constant value, and wherein the second diameter of the second recess portion has a constant value.

9. The developing device according to claim 4, wherein, in the axis line direction, the end portion of the film is nipped between the seal member and the developing roller within a range in which the recess portion is arranged.

* * * * *